United States Patent [19]

Guenther et al.

[11] 4,196,480

[45] Apr. 8, 1980

[54] TOILET SUPPORT

[75] Inventors: Harold E. Guenther; Kenneth H. Klein, both of Plymouth, Mich.

[73] Assignee: C. D. Sparling Co., Plymouth, Mich.

[21] Appl. No.: 654,184

[22] Filed: Feb. 2, 1976

Related U.S. Application Data

[62] Division of Ser. No. 404,933, Oct. 10, 1973, abandoned.

[51] Int. Cl.[2] ..... E03D 11/00; A47C 7/54

[52] U.S. Cl. ..... 4/254; 4/134; 297/411

[58] Field of Search ..... 4/1, 134, 185 R, 185 H, 4/240, 254; 297/336, 411; D23/53, 70; 248/345.1, 240, 240.4

[56] References Cited

U.S. PATENT DOCUMENTS

| | | | |
|---|---|---|---|
| 2,963,254 | 12/1960 | Rodgers | 248/240.4 X |
| 3,174,162 | 3/1965 | Sinton et al. | 248/240.4 X |
| 3,398,410 | 8/1968 | Sparling | 4/254 |
| 3,405,411 | 10/1968 | Brown | 4/254 |
| 3,474,471 | 10/1969 | Matibag | 4/254 |
| 3,574,242 | 4/1971 | Trowbridge | 4/254 |

*Primary Examiner*—Stuart S. Levy

*Attorney, Agent, or Firm*—Barnes, Kisselle, Raisch & Choate

[57] ABSTRACT

A toilet support for use by invalids and the like wherein one or more arms are mounted on brackets supported adjacent the hinge for the seat of the toilet bowl for movement into and out of operative position such that in one position the arms can be gripped and engaged by the invalid and in another position said arms are out of the way.

7 Claims, 8 Drawing Figures

FIG. 5
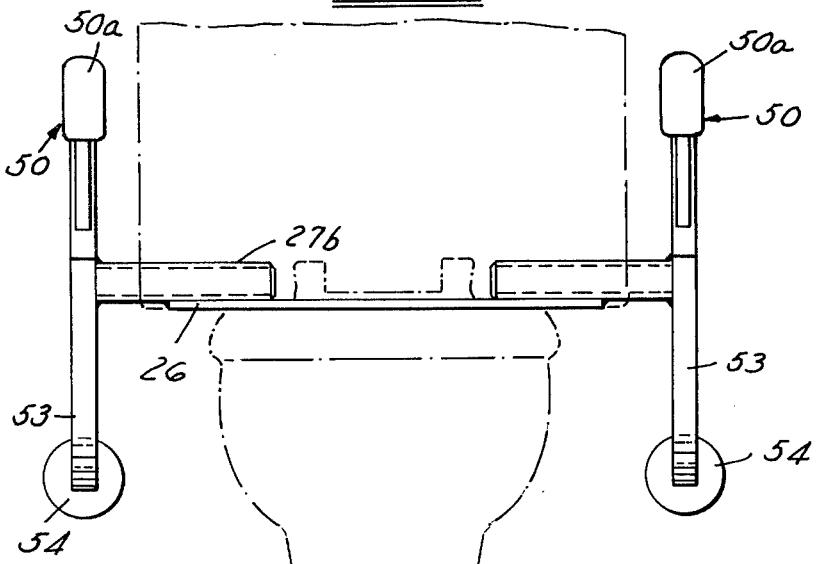
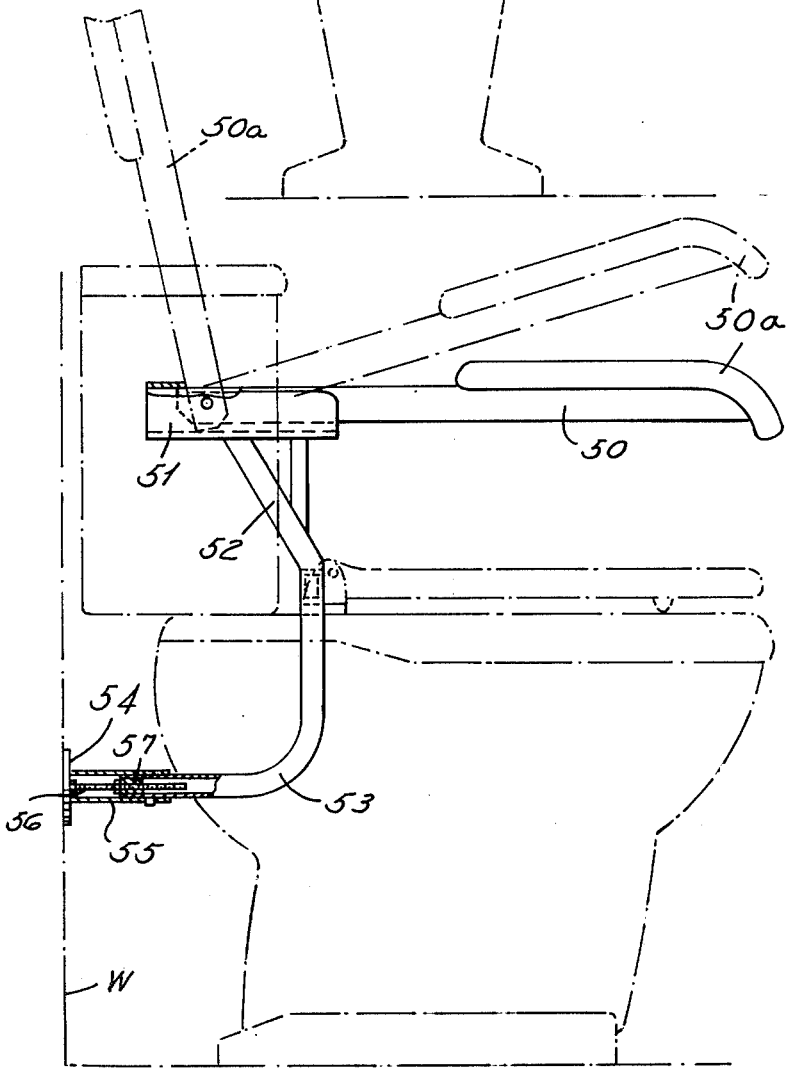
FIG. 6

TOILET SUPPORT

This application is a division of U.S. application Ser. No. 404,933, filed Oct. 10, 1973 now abandoned.

This invention relates to toilet supports for assisting invalids in the use of a toilet bowl.

BACKGROUND OF THE INVENTION

In both institutions and homes wherein the aged or invalid persons reside, it has become more common for some form of support to be provided for assisting the persons in the use of the toilet facilities. One of the considerations in such devices is that the area surrounding the toilet bowl be readily accessible for seating the person and for cleaning and that the device be sufficiently strong to withstand the weight of the person using it. Among the objects of the invention are to provide toilet supports which utilize the strength of the toilet bowl for supporting part of the weight of the user and which incorporate novel means for providing the bearing; which either keep the area surrounding the toilet bowl free or easily accessible; and which provide a clean easily maintained construction.

SUMMARY OF THE INVENTION

The toilet support embodying the invention comprises one or more arms mounted on brackets supported adjacent the hinge for the seat of the toilet bowl for movement into and out of operated position such that in one position the arms can be gripped and engaged by the invalid and in another position said arms are out of the way. Novel means are provided for supporting the arms that have hand engaging portions for movement into and out of operative position and for ready access to the area surrounding the toilet bowl for cleaning and the like.

DESCRIPTION OF THE DRAWINGS

FIG. 5 is a front elevational view of a further modified form of the invention.

FIG. 6 is a part sectional side elevational view of the device shown in FIG. 5.

DESCRIPTION

Figure 1:
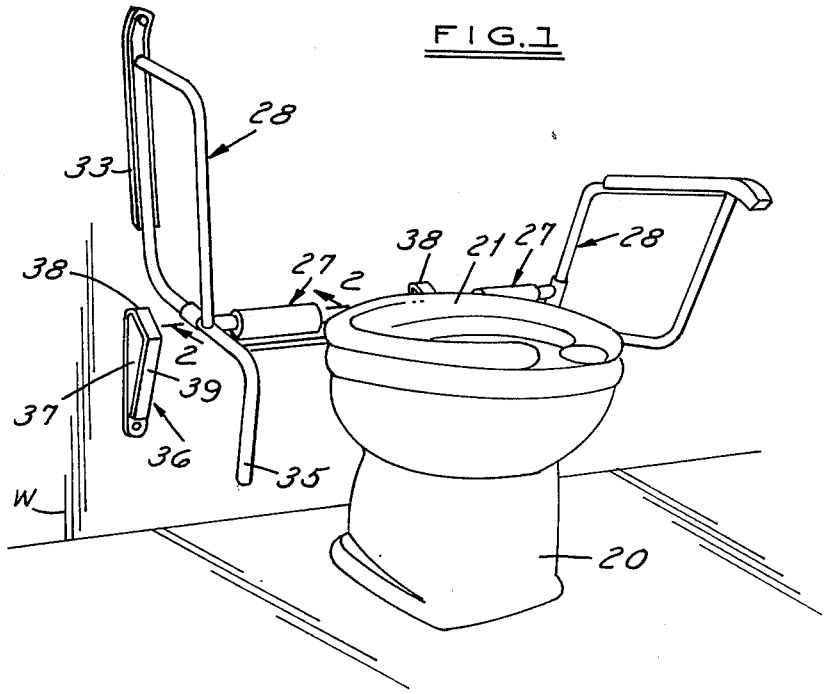
FIG. 1 is a perspective view of a toilet support embodying the invention in position on a toilet bowl.

Referring to FIG. 1, the invention relates to toilet supports for use in connection with a toilet bowl 20 of conventional construction having a toilet seat 21 hinged adjacent the upper rear end of the toilet bowl by a bracket 22 supporting a hinge pin 23 and retained thereon by bolts 24 and nuts 25 threaded thereon.

Each of the forms of the invention hereinafter described comprises a pair of arms adapted to be used alongside the toilet bowl although, as will be apparent only one can be used if space limitations prevent the use of two.

In accordance with the invention, a mounting plate 26 which is generally flat is interposed between the bracket 22 and the bowl 20 and bolts 24 extend therethrough. Plate 26 provides a support for spaced bearings 27 for arms 28 which are pivoted by the bearings 27 on the plate 26.

Figure 3:
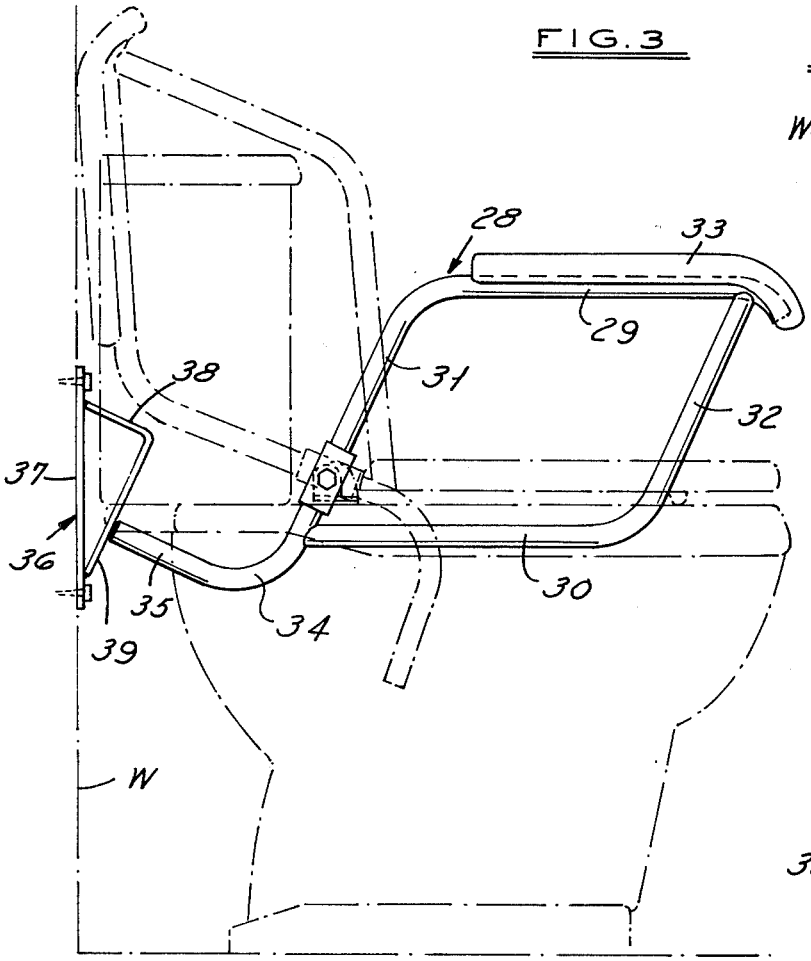
FIG. 3 is a side elevational view of the apparatus shown in FIG. 1 showing the parts in a different operative position.

As shown in FIG. 3, each arm 28 is made of tubular metal comprising, when the arm is in position for use, a top portion 29, bottom portion 30 and side portions 31, 32 connected to form a parallelogram. The top portion 29 has a wood or plastic hand gripping part 33 fixed thereto. As shown in FIG. 3, the arm 28 is in operative position for gripping by an aged or invalid person. The arm 28 can be swung to the broken line position shown in FIG. 3 out of the way for access and normal use of the toilet.

As further shown in FIGS. 1 and 3, the arm 28 comprises an extension or projection 34 which extends outwardly from side portion 31 past bottom portion 30 and thereafter has a free end 35 at a right angle. In the normal operative position with the hand engaging portion 33 extending horizontally, the projection 35 extends upwardly at an acute angle to the horizontal into engagement with a bracket 36. Bracket 36 is generally triangular in shape and may be made of one or several pieces of metal including a vertical leg 37 forming the hypotenuse of the triangle, a short leg 38 and a long leg 39 at a right angle to the short leg 38. The angle which leg 39 makes with leg 37 is substantially equal to the acute angle that end 35 of arm 28 makes with the horizontal when the arm is in the solid line operative position shown in FIG. 3. Bracket 36 is mounted on the vertical surface of wall W with its leg 37 engaging the wall and held in position either by screws or by appropriate adhesives such as an epoxy adhesive. When so mounted, the projection 35 contacts surface 36 at a normal or 90° relationship. In this manner, the load or weight on the arm 28 is transmitted to the bearing 27 as well as to the wall through the bracket 37. The load on bracket 36 does not tend to displace the bracket vertically along the wall.

Figure 3B:
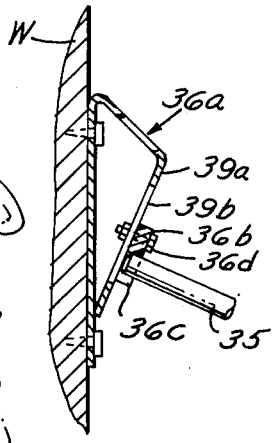
FIG. 3B is a fragmentary sectional view taken along the line 3B—3B in FIG. 3A.
Figure 3A:
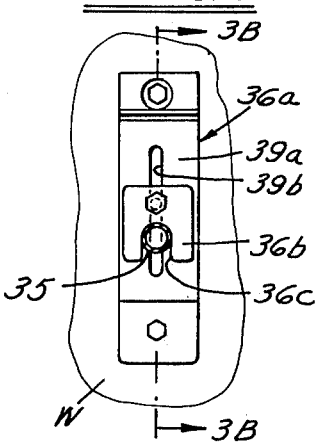
FIG. 3A is a part sectional view of a modified form of the invention.

In the modified form of the invention shown in FIGS. 3A and 3B, the bracket 36*a* is made of a single piece and leg 39*a* has an elongated slot 39*b* therein. A plastic retainer 36*b* is held in adjustable position on the leg 39*a* by a bolt 36*d* extending through the slot. Retainer 36*b* includes an open-ended slot 36*c* into which the end of projection 35 extends. In this manner, the end of the projection 35 is given lateral stability.

Figure 2:
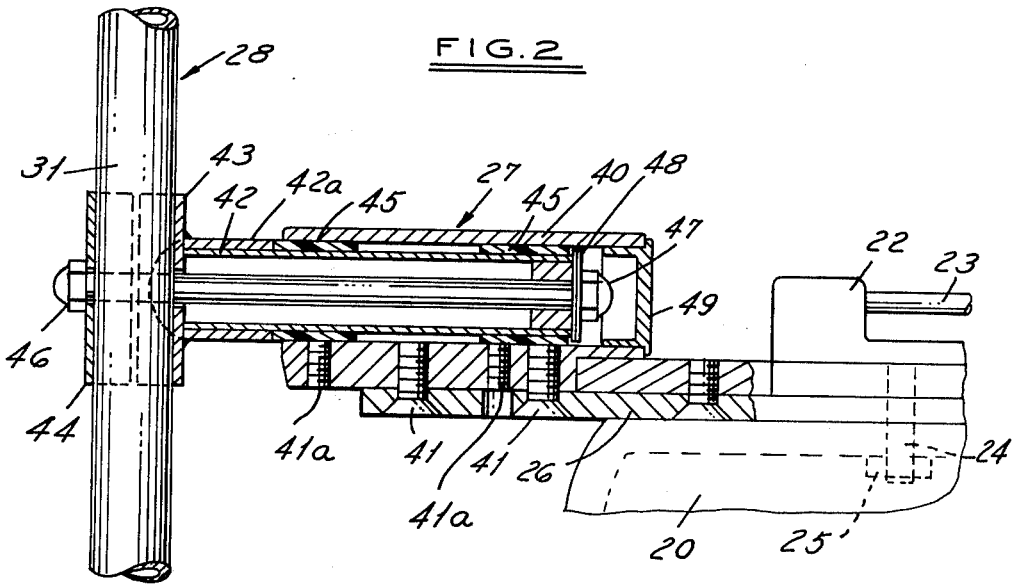
FIG. 2 is a fragmentary sectional view on an enlarged scale taken along the line 2—2 in FIG. 1.

Referring to FIG. 2, the bearing 27 comprises a housing 40 which is tubular and fixed to the plate 26 by screws 41. A tube 42 is welded to one of two tubes encircling sections 43, 44 surrounding the side portion 31 of the arm 28. Tube 42 extends through spaced plastic sleeve bearings 45 in the tubular housing 40. A bolt 46 extends through the sections 43, 44 and portion 31, and into and through the tubular portion 42. A nut 47 threaded on bolt 46 engaging washers 48 which in turn engage the right bearing 45 to retain the tube 42 and in turn the arm in position axially of the bearing 27. A cap 49 is provided over the end of the housing 40 to close the opening into which the tube 42 extends. A short tubular spacer 42*a* surrounds tube 42 to space the arm axially of bearing 27. Screws 41*a* extend through the housing 40 into frictional engagement with the bearings 45 so that sufficient friction is provided to tend to retain the arms in any position. This prevents the arms from inadvertently falling under the action of gravity and causing possible injury or damage.

Figure 4:
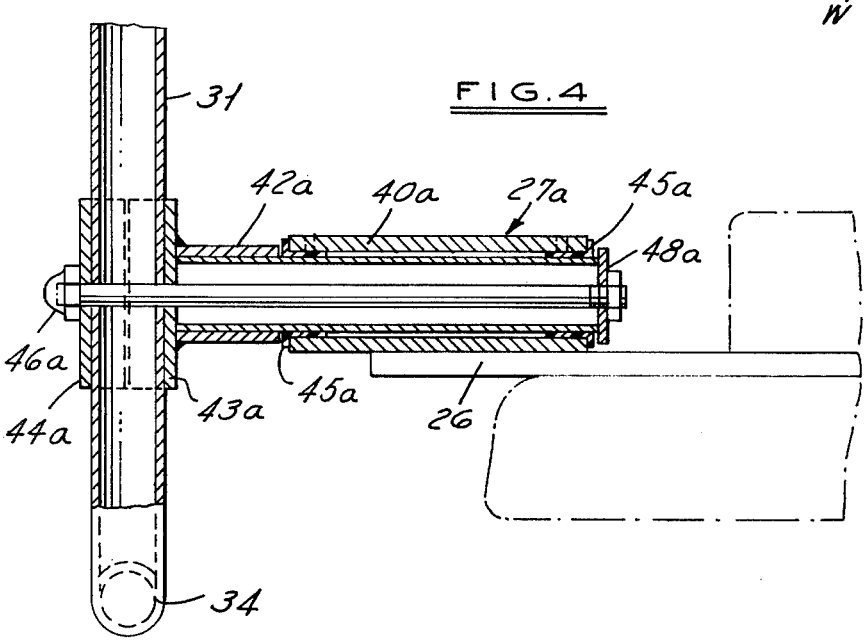
FIG. 4 is a sectional view similar to FIG. 2 of a modified form of the invention.

In the modified construction shown in FIG. 4, a similar construction is used except that the bearing 27*a* has sleeve bearings 45*a* with radially extending flanges that bear against the ends of housing 40*a*. The washer 48*a* engages the exterior of the right sleeve bearing 45*a*.

It can thus be seen that there has been provided an arrangement wherein in one position the arm is in operative gripping position and in another it is moved out of the way for access or normal use of the toilet. In both positions, the arm is clear of the area surrounding the toilet bowl for ready access to the area surrounding the toilet bowl.

In the form of the invention shown in FIGS. 5 and 6, each arm 50 having a hand gripping part 50*a* is pivoted to a bracket 51 for movement between a normal position shown in solid lines in FIG. 6 to an out of the way position shown in broken lines. Bracket 51 is U-shaped and is engaged by arm 50 to limit its downward movement. Bracket 51 is fixed to the upper end of a tube 52 which is fixed intermediate its ends to a tubular section 27*b* which in turn is mounted on plate 26. The lower end of tube 52 extends at a right angle as at 53 horizontally toward the wall W. In this form, a pad 54 is fixed to a sleeve 55 telescoped over the end of the portion 53. A bolt 56 threaded into a nut 57 in the projection 53 limits the inward movement of the pad 54. In this manner, the force on the arm 50 is transmitted to the bearing 27*b* and to the wall through the pad 54. In this form, the arm 50 is swung upwardly to the broken line positions out of the way and the bracket 51 and tube portions 52, 53 of the arm remain in the same relationships to the toilet bowl at all times.

We claim:

1. In a toilet support for use with a toilet bowl, the combination comprising an arm having a hand gripping portion, bearing means adapted to be mounted on said toilet bowl for mounting said arm on said toilet bowl, said arm including a projection, a stationary abutment adapted to be mounted on a wall adjacent and rearwardly of said toilet bowl, said projection adapted to extend rearwardly when said hand gripping portion is substantially horizontal to engage said stationary abutment, said bearing means and said projection comprising the sole support for said arm when said projection is in engagement with a stationary abutment.

2. The combination set forth in claim 1 wherein said stationary abutment comprises a bracket adapted to be mounted on a wall at the rear of said toilet bowl, said bracket having a flat wall contacting portion adapted to extend vertically along said wall and a second portion extending upwardly at an acute angle to said first-mentioned wall contacting portion and engaged by said projection.

3. The combination set forth in claim 2 wherein said projection makes a right angle with said second-mentioned portion of said bracket.

4. The combination set forth in claim 2 wherein the angle which said projection makes with the horizontal when in contact with said bracket is substantially equal to the angle that the second portion of the bracket makes with the vertical.

5. The combination set forth in claim 1 wherein said bearing means rotatably supports said arm about a horizontal axis.

6. The combination set forth in claim 1 wherein said projection is adapted to engage said stationary abutment at substantially a right angle.

7. The combination set forth in claim 1 wherein said stationary means includes means for laterally restraining said projection.

* * * * *